United States Patent [19]

Windges

[11] Patent Number: 4,656,694

[45] Date of Patent: Apr. 14, 1987

[54] DUAL CHUTE FIBER TUFT FEEDING APPARATUS

[75] Inventor: Bernhard Windges, Monchen-Gladbach, Fed. Rep. of Germany

[73] Assignee: Trutzschler GmbH & Co. KG, Mönchengladbach, Fed. Rep. of Germany

[21] Appl. No.: 827,745

[22] Filed: Feb. 10, 1986

[30] Foreign Application Priority Data

Feb. 11, 1985 [DE] Fed. Rep. of Germany ..... 3504607
Jun. 7, 1985 [DE] Fed. Rep. of Germany ..... 3528853
Aug. 24, 1985 [DE] Fed. Rep. of Germany ..... 3530327

[51] Int. Cl.[4] ..... D01G 23/02; D01G 15/40
[52] U.S. Cl. ..... 19/105
[58] Field of Search ..... 19/105

[56] References Cited

U.S. PATENT DOCUMENTS 4,219,289 8/1980 Trützschler ..... 19/105 X
4,387,486 6/1983 Keller ..... 19/105
4,394,790 7/1983 Keller et al. ..... 19/105
4,404,710 9/1983 Wood ..... 19/105
4,476,611 10/1984 Keller et al. ..... 19/105
4,520,530 6/1985 Pinto ..... 19/105
4,528,723 7/1985 Hergeth et al. ..... 19/105

FOREIGN PATENT DOCUMENTS 2135705 9/1984 United Kingdom ..... 19/105

*Primary Examiner*—Louis K. Rimrodt
*Attorney, Agent, or Firm*—Spencer & Frank

[57] ABSTRACT

An apparatus for feeding a fiber lap to a card, includes opening roller arranged under the feed roller to receive fiber material therefrom and to advance the fiber material into the feed chute through the upper end thereof. There are further provided delivery rollers at a lower end of the feed chute for withdrawing fiber material therefrom as a fiber lap; and an air circulating arrangement for guiding a compressing air stream to a location bounded by the opening roller and then introducing the compressing air stream into the feed chute through the upper end thereof, driving the air stream through the feed chute to compress fiber material therein and withdrawing air from openings in a lower portion of the feed chute.

7 Claims, 2 Drawing Figures

DUAL CHUTE FIBER TUFT FEEDING APPARATUS

BACKGROUND OF THE INVENTION

This invention relates to an apparatus for feeding a fiber lap to the input of a carding machine or a roller card unit and is of the type which has an upper or reserve chute which is charged with fiber tufts from above and a lower or feed chute which is situated underneath the reserve chute and whose lower, discharge end supplies the fiber lap formed from the fiber tufts in the feed chute. For this purpose, the fiber tufts are compressed in the feed chute with the aid of a circulating air stream which enters at the top of the feed chute and exits the same through air outlet openings at its lower end. Between the outlet of the reserve chute and the inlet of the feed chute there is arranged an opening roller which forwards the tufts from the reserve chute to the feed chute. The fiber tuft is supplied to the opening roller by a feed roller which is situated at the lower end of the reserve chute.

According to prior art constructions, the compressing air stream, flowing from the driving fan, enters into an enlarged space which essentially is situated adjacent a lateral peripheral face of the opening roller. In this space, the fiber tufts are thrown against the opening roller, their delivery is taken over by the compressing air stream and subsequently they are introduced into the feed chute whose upper (inlet) opening is arranged approximately tangentially to the opening roller. It is a disadvantage of this arrangement that the compressing air stream is not tightly guided in the enlarged space.

SUMMARY OF THE INVENTION

It is an object of the invention to provide an improved apparatus of the above-outlined type which eliminates the noted disadvantage and in which the guidance of the fiber carrying compressing stream is significantly improved.

This object and others to become apparent as the specification progresses, are accomplished by the invention, according to which, briefly stated, an air channel is provided which connects the location where the compressing air stream enters the zone of the opening roller with the upper (inlet) opening of the feed chute.

The above-defined measure according to the invention improves the guidance of the compressing air stream which carries the fiber material. Expediently, the air channel extends in a lateral zone of the opening roller, that is, assuming a horizontal orientation of the opening roller axis, the air channel extends radially adjacent a lateral peripheral portion of the opening roller. Preferably, the air channel is of curved configuration generally following the curvature of the opening roller. By virtue of these measures, the compressing air stream is guided along one part of the periphery of the opening roller which enhances the removal of the fiber tufts from the opening roller and the introduction thereof into the feed chute. Preferably, the air channel opens into the feed chute underneath the opening roller and the introduction of the compressing air stream into the feed chute occurs adjacent a lower (downwardly oriented) circumferential portion of the opening roller. The provision of the air channel terminus under the opening roller improves the removal of fiber tufts therefrom and further, a directed air stream is obtained which eliminates flow turbulences at the entrance of the feed chute. This arrangement has the further advantage that a removal of the fiber tufts from the opening roller in the downward direction is enhanced by gravity. Preferably, the compressing air stream is introduced between the feed roller and the upper zone of the feed chute.

According to a further feature of the invention, the corner formed at the beginning of the air channel is at a small distance from the opening roller. This feature too, helps to eliminate air turbulences which may be generated at the location of the introduction of the compressing air stream into the zone of the opening roller. In particular, an air inflow between the opening roller and the upper roller cover is prevented for eliminating air turbulences.

According to a further feature of the invention, the corner at the end of the wall zone underneath the opening roller is offset relative to the air channel in the direction of rotation of the opening roller which enhances air flow and prevents air turbulences.

DESCRIPTION OF THE PREFERRED EMBODIMENT

Figure 1:
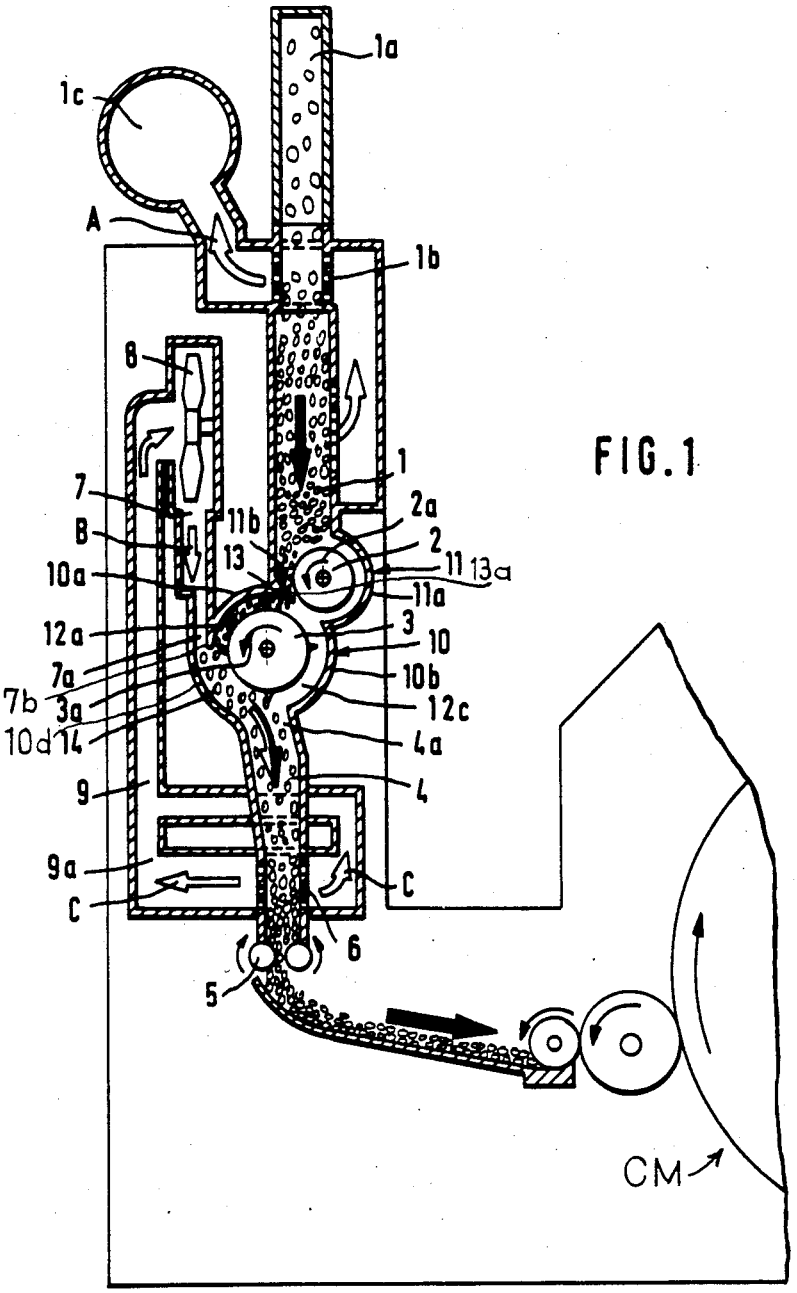
FIG. 1 is a schematic sectional side elevational view of a preferred embodiment of the invention.

Turning to FIG. 1, the tuft feeding apparatus shown therein is, as a rule, installed adjacent the input side of a carding machine CM. The apparatus includes a vertical reserve chute 1 which is charged at the top with finely opened fiber material. Such charging may be effected, for example, by a condenser in a supply and distributor conduit 1*a*. In the upper zone of the reserve chute 1 there are provided air outlet openings 1*b* through which the fiber tuft conveying air leaves the reserve chute 1 after the separation of the fiber tufts and is introduced into a suction device 1*c* as indicated by the arrow A.

Figure 2:
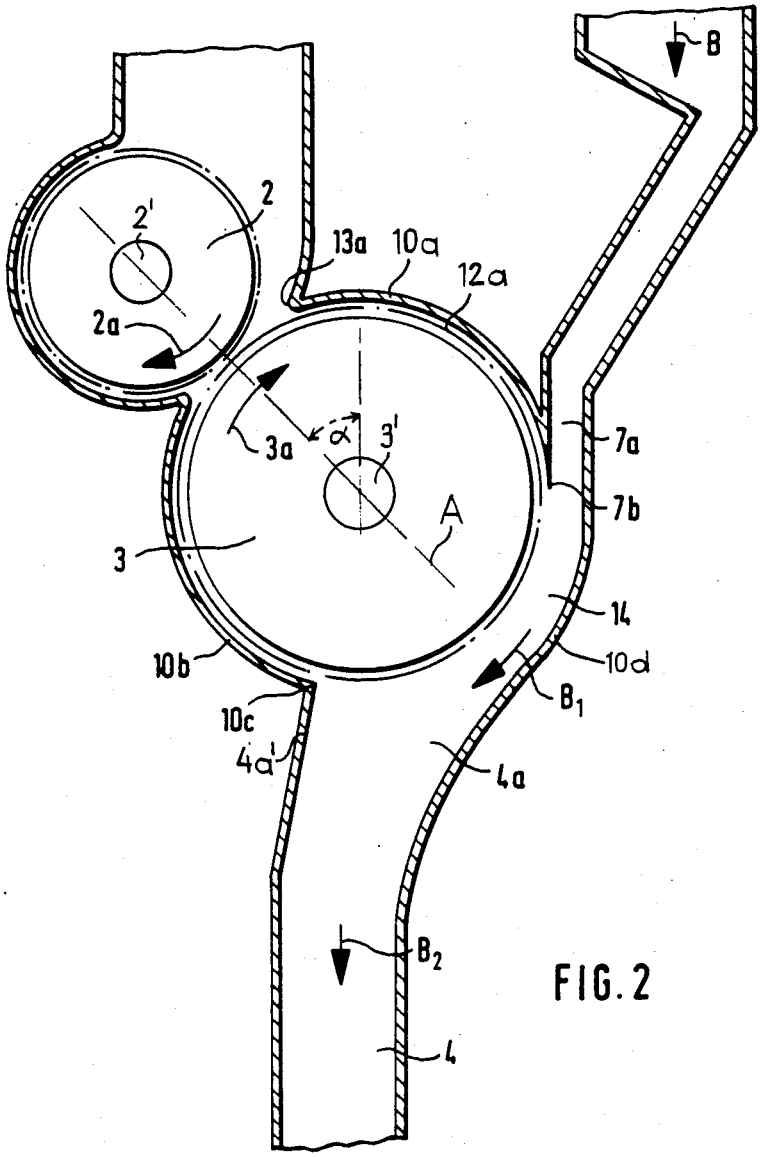
FIG. 2 is a schematic sectional side elevational view of an enlarged detail of the preferred embodiment.

The lower outlet area of the reserve chute 1 is largely occupied by a feed roller 2 which cooperates with a feed baffle 13 attached to the inside of the reserve chute 1. The feed roller 2 advances the fiber tufts from the reserve chute 1 and through the gap which it defines with the feed baffle 13, to an opening roller 3 which is situated below the feed roller 2 and which is provided with a pin or sawtooth wire clothing. One part of the peripheral surface of the opening roller 3 is oriented towards and is in direct communication with the inlet 4*a* of a vertically oriented feed chute 4. The opening roller 3 which rotates in the direction of the arrow 3*a* advances the fiber material, which it entrains from the feed roller 2, into the feed chute 4. The feed chute 4 has, at its lower end, two delivery rollers 5 which rotate in opposite directions and which withdraw the fiber material from the feed chute 4 and advance the material (fiber lap) to the card CM. The above-described construction generally corresponds to that of an "EXACTAFEED FBK" model, manufactured by Trützschler GmbH & Co. KG, Mönchengladbach, Federal Republic of Germany. The feed roller 2 and the opening roller 3 may rotate co-directionally as shown by arrows 2*a*, 3*a* in FIG. 1 or in opposite directions as indicated in FIG. 2.

The walls of the feed chute 4, at the lower portion thereof, are provided with air outlet openings 6 which extend up to a certain height of the feed chute 4. The upper entrance opening of the feed chute 4 communicates by means of an air channel 14 with a space 7, at the upper end of which there is arranged a fan 8. The rotating feed roller 2 and and opening roller 3 continuously deliver, at a certain flow rate, fiber material into the feed chute 4 and an equal quantity of processed fiber material is withdrawn from the bottom of the feed chute 4 by the delivery rollers 5 and advanced to the carding machine CM.

In order to uniformly densify the fiber material in the feed chute 4 and to maintain the discharged fiber quantities in the fiber lap constant, the fan 8 drives air downwardly in the space 7 through a constriction 7*a* of, for example, 8 mm wide. The air stream is directed into the feed chute 4 to impinge on and pass through the fiber tuft column accumulating therein. Thus, the fan 8 draws air from an air channel 9 and forces the air through the fiber tuft column situated in the feed chute 4. Thereafter, the air exits the feed chute 4 through the air outlet openings 6 at the lower end of the feed chute 4 as indicated by the arrows C. The air outlet openings 6 directly communicate with a lower terminus 9*a* of the air channel 9 whose upper end terminates immediately at the suction (intake) side of the fan 8.

The opening roller 3 is surrounded by a housing 10 formed essentially of two arcuate housing portions 10*a* and 10*b*, whereas the feed roller 2 is surrounded by a housing 11 formed of housing parts 11*a* and 11*b*. The housing parts 10*a* and 10*b* conform to the periphery of the opening roller 3, whereas the wall portions 11*a* and 11*b* conform to the periphery of the feed roller 2. The housing 10 forms, between the inner face of the housing portion 10*a* and the opening roller 3 a fiber guiding channel 12*a* for the fiber tufts. The construction 7*a* is adjoined, at its downstream end adjacent the opening roller 3, by the air channel 14 which, in turn, opens into the upper inlet 4*a* of the feed chute 4 below the opening roller 3. The wall portion 10*b* adjoins the inlet 4*a* and bounds an annular channel 12*c* which extends partially around the opening roller 3 to the feed roller 2. At the junction of the wall portions 10*a* and 11*b*, situated adjacent the lower part of the feed roller 2 there is formed a feed baffle 13 whose edge 13*a* is oriented opposite the direction of rotation of the opening roller 3. The compressing air stream whose direction is indicated by the arrow B upstream of the opening roller 3 is introduced between the feed roller 2 and the upper zone of the feed chute 4, whereby the flow direction $B_1$ of the compressing air stream in the zone of the opening roller 3 is codirectional with the direction of rotation of the opening roller 3. The housing portion 10*a* terminates, remote from the feed baffle 13, in a corner 7*b* which is situated immediately radially adjacent for example, at a distance of 5 mm the opening roller 3 and which defines the downstream end of the channel 12*a* and the constriction 7*a*.

Turning now to FIG. 2, the feed roller 2 and the opening roller 3 are arranged at an oblique orientation with respect to one another, that is, an imaginary line A connecting the rotary axes 2', 3' of the feed roller 2 and the opening roller 3, respectively, forms an angle $\alpha$ other than zero with the vertical. The direction B of the compressing air current which is introduced into the feed chute between the feed roller 2 and the upper zone 4*a* of the feed chute coincides with the direction of rotation 3*a* of the opening roller 3 and is tangential thereto. The opening roller 3 advances the fiber tufts into the air stream in the air channel 14. The latter is oriented generally downwardly and is bounded by a substantial part of a lateral cylindrical peripheral surface portion of the opening roller 3, whereby a removal of the fiber tufts from the clothing of the opening roller 3 is aided by the compressing air stream B which flows about a part of the circumference of the opening roller 3, as indicated at $B_1$. The air channel 14 is bounded externally by a housing portion 10*d* which generally conforms to the curvature of the opening roller 3.

The outer circumference of the clothing (teeth, needles or the like) provided on the feed roller 2 and the opening roller 3 are designated with a circle drawn in dash-dot lines.

The air channel 14 opens into the feed chute 4 underneath the opening roller 3 and thus the compressing air stream B enters into the upper inlet zone 4*a* of the feed chute 4 adjacent a lower peripheral portion of the opening roller 3. The corner 10*c* which is formed by the junction of the ends of the housing portion 10*b* and a wall portion 4*a'* bounding the inlet 4*a* of the feed chute 4 is recessed in a direction away from the air channel 14, that is, in the direction of rotation 3*a* of the opening roller 3. Thus, the corner 10*c* is situated externally of the main air flow into the inlet 4*a*, whereby the corner 10*c* does not interfere with the compressing air stream as it enters the feed chute 4, whereby the risks of air turbulences are eliminated. The cross section of the inlet zone 4*a* of the feed chute 4 tapers downwardly. The compressing air stream, entraining the fiber tufts, is designated at $B_2$ as it enters the feed chute 4 proper.

It will be understood that the above description of the present invention is susceptible to various modifications, changes and adaptations, and the same are intended to be comprehended within the meaning and range of equivalents of the appended claims.

What is claimed is:

1. In an apparatus for feeding a fiber lap to a card, including the upper reserve chute having an upper end through which fiber material is introduced into the apparatus, a feed roller situated at a lower end of said reserve chute and arranged for withdrawing fiber material from said reserve chute; a feed chute having an upper end situated adjacent to the lower end of said reserve chute; an opening roller situated in a space between the lower end of the reserve chute and the upper end of the feed chute; said opening roller being arranged under the feed roller to receive fiber material therefrom and to advance the fiber material into said feed chute through the upper end thereof; delivery rollers arranged at a lower end of said feed chute for withdrawing fiber material therefrom as a fiber lap; and air circulating means for guiding a compressing air stream to a location spaced from the upper end of said feed chute and bounded by said opening roller, subsequently introducing the compressing air stream into the feed chute through the upper end thereof, driving the air stream through said feed chute to compress fiber material therein and withdrawing air from openings in a lower portion of said feed chute, the improvement comprising means for introducing the compressing air stream into said location tangentially to said opening roller; and means defining an air channel connecting said location with said upper end of said feed chute for guiding said compressing air stream and fiber tufts from said location in an arcuate path along and in contact with a peripheral portion of said opening roller into said upper end of said feed chute; said means defining the air channel including said peripheral portion of said opening roller and a wall radially spaced from and generally following the curvature of the periphery of the opening roller; said wall extending from said location to said upper end of said feed chute, whereby said air channel has a curved course extending in a circumferential direction of said opening roller laterally thereof from said location to said upper end of said feed chute.

2. An apparatus as defined in claim 1, wherein said air channel opens into the upper end of said feed chute in a zone extending below said opening roller, along a peripheral portion thereof.

3. An apparatus as defined in claim 1, wherein said location is situated between said feed roller and said upper end of said feed chute.

4. An apparatus as defined in claim 1, wherein said opening roller has a direction of rotation; the compressing air stream being oriented codirectionally with said direction of rotation in said air channel.

5. An apparatus as defined in claim 1, further comprising a wall radially spaced from said opening roller and extending in a circumferential direction about an upper peripheral portion of said opening roller; said wall terminating in a corner at said location; said corner being situated at a small radial distance from the opening roller.

6. An apparatus as defined in claim 1, further comprising a wall radially spaced from said opening roller and extending in a circumferential direction about a lower peripheral portion of said opening roller; said wall terminating in a corner at said upper end of said feed chute; said corner being recessed in a direction away from said air channel.

7. An apparatus as defined in claim 1, wherein said upper end of said feed chute tapers in a direction away from said opening roller.

* * * * *